US006261129B1

(12) United States Patent
Kusagaya

(10) Patent No.: US 6,261,129 B1
(45) Date of Patent: Jul. 17, 2001

(54) CONNECTOR DEVICE HAVING AN ERRONEOUS FITTING PREVENTING PORTION

(75) Inventor: Yasuo Kusagaya, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/481,541

(22) Filed: Jan. 12, 2000

(30) Foreign Application Priority Data

Jan. 18, 1999 (JP) ..... 11-009580

(51) Int. Cl.[7] ..... H01R 13/64
(52) U.S. Cl. ..... 439/677; 439/488
(58) Field of Search ..... 439/154, 677, 439/680, 660, 488, 162, 163, 164

(56) References Cited

U.S. PATENT DOCUMENTS 4,245,875 * 1/1981 Shaffer et al. ..... 439/144
4,361,375 * 11/1982 Bailey et al. ..... 439/680

* cited by examiner

*Primary Examiner*—Brian Sircus
*Assistant Examiner*—Hae Moon Hyeon
(74) *Attorney, Agent, or Firm*—Jay H. Maioli

(57) ABSTRACT

A connector device, with improved reliability of connection having a second connector half provided with a protrusion which falls into an engaging groove of a first connector half, an erroneous fitting preventing portion is formed in the first connector half so as to be deformed or broken by the protrusion of the second connector half when the first and second connector halves are erroneously fitted. Also, in a connector device composed of a plug and a socket into which the plug is fitted, uneven portions are formed on engaging surfaces with the plug and/or on engaging surfaces with the socket. Further, in an electronic device having at least one of a plug and a socket of the connector device, uneven portions are formed on engaging surfaces of the plug with the socket and/or on engaging surfaces of the socket with the plug.

8 Claims, 9 Drawing Sheets

CONNECTOR DEVICE HAVING AN ERRONEOUS FITTING PREVENTING PORTION

BACKGROUND OF THE INEVNTION

1. Field of the Invention

This invention relates to a connector device, and an electronic device and a plug using the same, and more particularly, suitably applied to a connector device which prevents erroneous insertion, and an electronic device and a plug using the same.

2. Description of the Related Art

In an electronic device such as a video camera, a power supply, a variety of data and so on are inputted from an external power source, various data sources and so on through a connection cable or the like. The video camera is connected to the connection cable by fitting a plug of a connector device, which is a male side connection terminal of the connection cable, into a socket of the connector device, which is a female side connection terminal of the video camera, in a predetermined state.

In this way, the power supply, variety of data and so on are inputted to the video camera from the power source, various data sources and so on.

However, since the connector device as mentioned above has been reduced in size, it is highly likely to reversely fit the plug into the socket instead of correctly fitting them or to obliquely insert the plug into the socket, causing a problem that the socket and plug are deformed or broken due to such mis-engagement.

In such a case, both the socket and the plug are susceptible to breakage. However, a broken plug on the connection cable side may be fixed by replacing it with a spare part for repair, whereas a broken socket on the video camera side encounters difficulties in repairing only the socket since the socket is integrated (set up) in the video camera. Thus, the video camera itself cannot be used when the socket is repaired. In addition, this also causes an increased cost.

SUMMARY OF THE INVENTION

In view of the foregoing, an object of this invention is to provide a connector device which is capable of improving the reliability of connection sufficiently for practical use, and an electronic device and a plug using the same.

The foregoing object and other objects of the invention have been achieved by the provision of a connector device having a first connector half with an engaging groove and a second connector half provided with a protrusion which falls into the engaging groove when the first connector half is fitted thereinto. In the connector device, an erroneous fitting preventing portion is formed in the first connector half so as to be deformed or broken by the protrusion of the second connector half when the first and second connector halves are erroneously fitted.

As a result, this connector device can obviate the socket provided in an electronic device such as a video camera from being broken by deforming or breaking the erroneous fitting preventing portion of the first connector half.

Also, in the present invention, a connector device has a plug and a socket for receiving the plug, wherein uneven portions are formed on engaging surfaces of the plug with the socket or on engaging surfaces of the socket with the plug.

As a result, with this connector device, if the plug is inserted into the socket obliquely with respect to the direction in which the plug should be fitted into the socket, the plug or the socket collides with the corresponding uneven portion, so that vibrations corresponding to the uneven portion can be sensed.

Further, in the present invention, a plug, which composes a connector together with a socket having a protrusion, is formed with an engaging groove into which the protrusion of the socket falls, when the plug is fitted into the socket, wherein an erroneous fitting preventing portion is formed so as to be deformed or broken by the protrusion of the socket when the plug is erroneously fitted into the socket.

As a result, in this plug, the socket provided in an electronic device such as a video camera can be obviated from being broken by deforming or breaking the erroneous fitting preventing portion of the plug.

Further, the present invention provides an electronic device having at least a first connector half of a connector including the first connector half having an engaging groove, and a second connector half provided with a protrusion which falls into the engaging groove when the first connector half is fitted thereinto. In the electronic device, an erroneous fitting preventing portion is formed in the first connector half so as to be deformed or broken by the protrusion of the second connector half when the first and second connector halves are erroneously fitted.

As a result, in this electronic device, the socket can be obviated from being broken by deforming or breaking the erroneous fitting preventing portion of the first connector half.

Further, the present invention provides an electronic device having at least one of a plug and a socket of a connector composed of the plug and the socket into which the plug is inserted. In the electronic device, uneven portions are formed on engaging surfaces of the plug with the socket and/or on engaging surfaces of the socket with the plug.

As a result, in this electronic device, if the plug is inserted into the socket obliquely with respect to the direction in which the plug should be fitted into the socket, the plug or the socket collides with the corresponding uneven portion, so that vibrations corresponding to the uneven portion can be sensed.

The nature, principle and utility of the invention will become more apparent from the following detailed description when read in conjunction with the accompanying drawings in which like parts are designated by like reference numerals or characters.

BRIEF DECRIPTION OFHTE DRAWINGS

DETAILED DESCRIPTION OF THE EMBODIMENT

Preferred embodiments of this invention will be described with reference to the accompanying drawings:

(1) First Embodiment

Figure 1A:
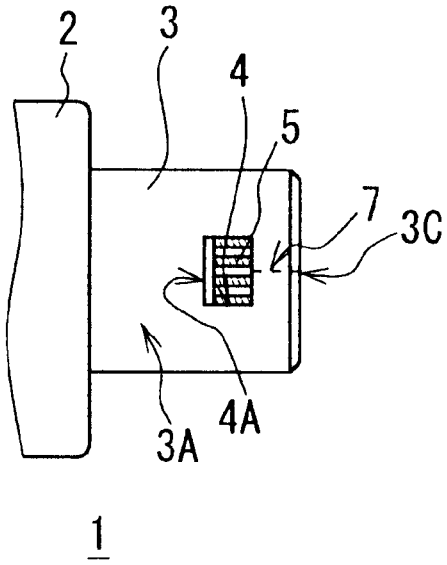
FIGS. 1A to 1C are schematic diagram and cross-sectional views illustrating the structure of a plug according to a first embodiment.
Figure 1B:
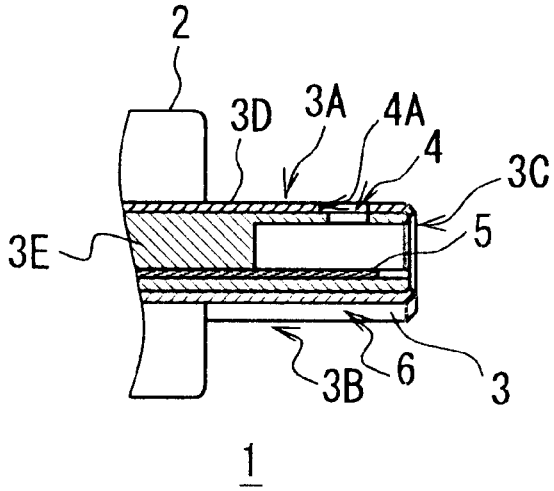
Figure 1C:
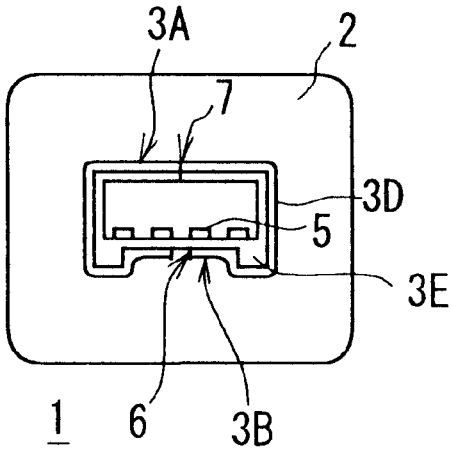

In FIGS. 1A to 1C, numeral 1 shows a plug considered as a first connector half of a first embodiment. A main body 2 is formed on one side thereof with an inserting protrusion 3. The inserting protrusion 3 has a top surface 3A having a through hole 4 at a predetermined position, and a bottom surface 3B having a recess 6 as an engaging groove.

Also, the inserting protrusion 3 is formed inside thereof with a plurality of connecting terminals 5 which extend through the main body 2 and are electrically connected to a cable (not shown) on the other side of the main body 2.

Actually, the inserting protrusion 3 is composed of a metal cover 3D made of metal such as phosphor bronze, and a resin base 3E made of resin such as LCP.

Figure 2A:
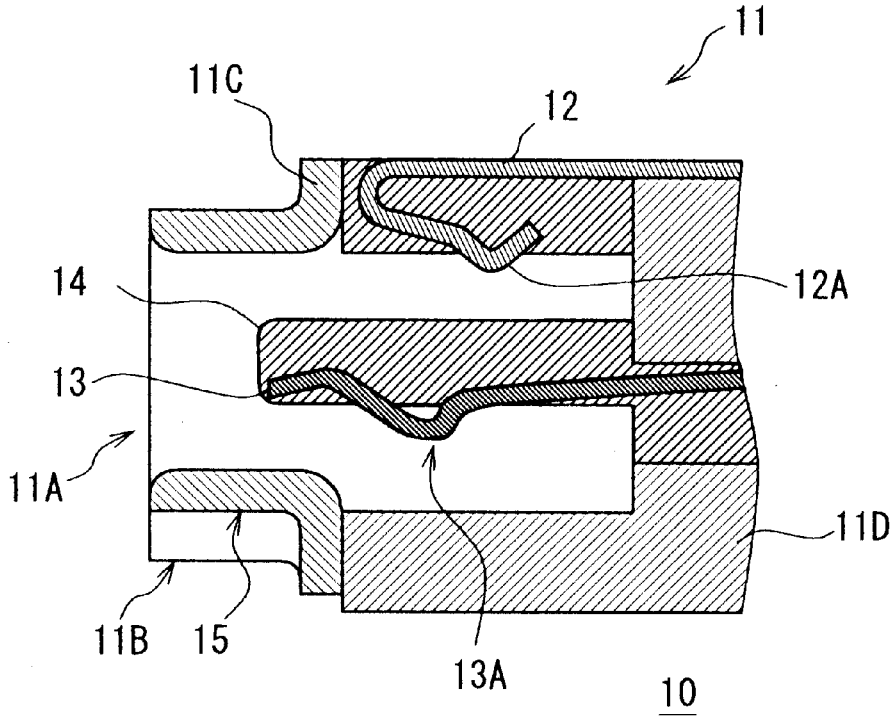
FIGS. 2A and 2B are a cross-sectional view and a schematic diagram illustrating the structure of a socket according to the first embodiment.
Figure 2B:
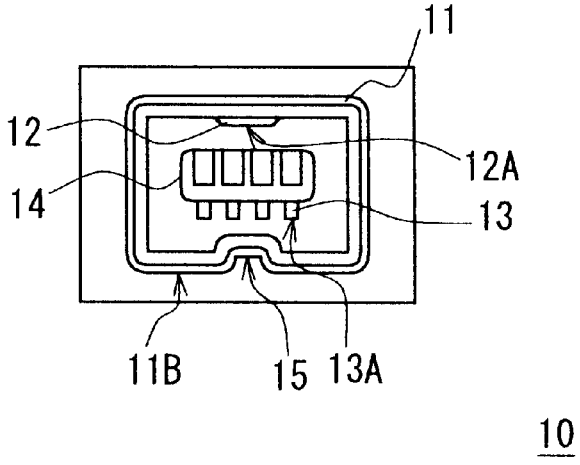

On the other hand, in FIGS. 2A and 2B, numeral 10 shows a socket considered as a second connector half corresponding to the plug 1 (FIGS. 1A to 1C). On one side of a main body 11, a receptacle 11A for receiving the plug 1 is opened. Inside the receptacle 11A, a detent terminal 12 is formed corresponding to the through hole 4 of the plug 1, and a recess 15 is formed in a bottom surface 11B of the main body 11.

In addition to the foregoing components, inside the receptacle 11A of the socket 10, a plurality of connecting contact pins 13 corresponding to the connecting terminals 5 of the plug 1 are formed such that they are covered with a connecting pin holder 14 except for their contact portions 13A protruding therefrom.

Actually, the main body 11 is formed of a metal cover 11C made of metal such as steel, and a resin base 11D made of resin such as LCP, PPC or the like.

Figure 3:
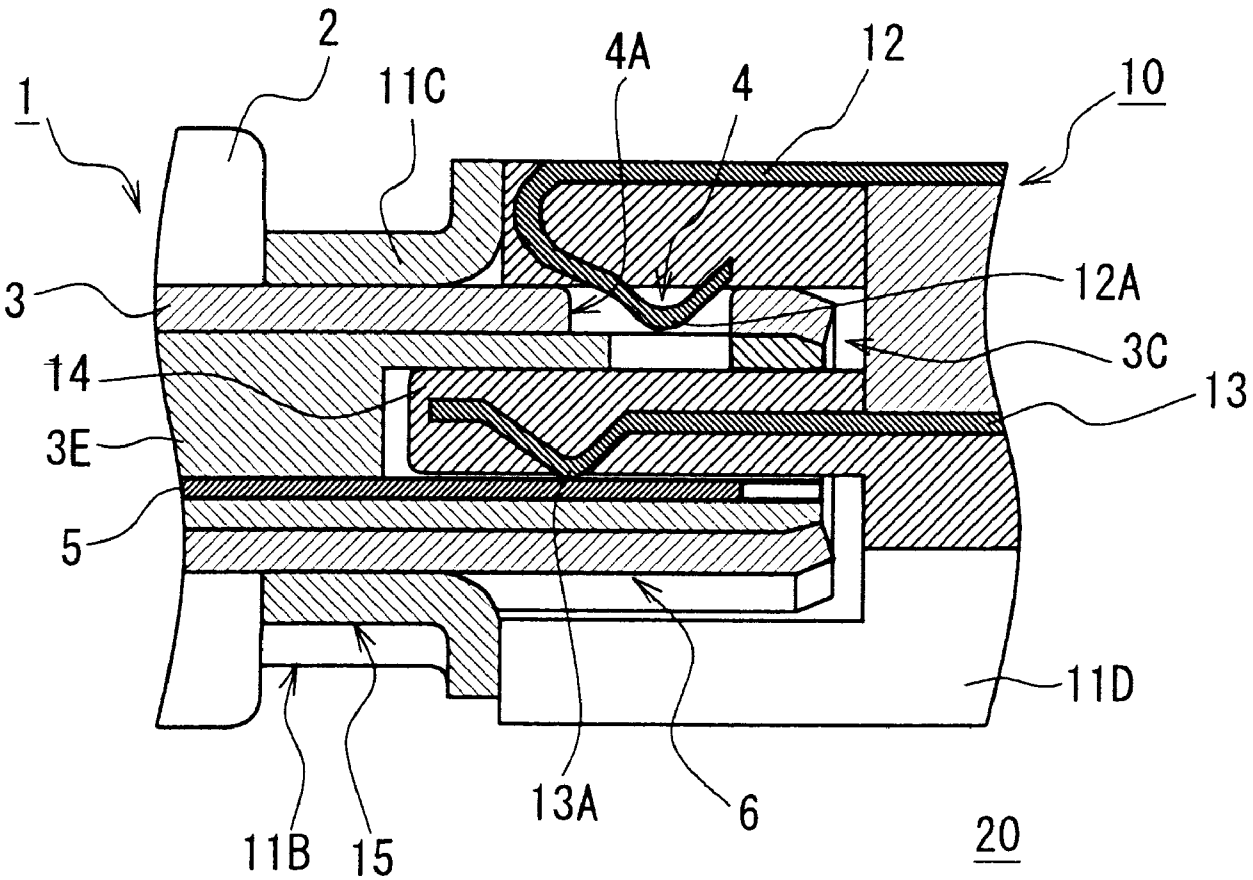
FIG. 3 is a cross-sectional view illustrating the structure of a connector device according to the first embodiment.

Thus, as illustrated in FIG. 3, the recess 6 of the plug 1 is aligned with the recess 15 of the socket 10, and the plug 1 is fitted into the receptacle 11A of the socket 10, causing the tip 12A of the detent terminal 12 of the socket 10 to fall into the through hole 4 of the plug 1, and the respective connecting terminals 5 of the plug 1 to electrically connect to the corresponding contact portions 13A of the connecting contact pins 13 of the socket 10, thus completing a connector device 20.

In addition to the structure as mentioned, the connector device 20 is formed with a break absorbing portion 7 (FIG. 1A) as an erroneous insertion preventing feature by adding a notch into a central portion or the like of the top surface 3A, between the through hole 4 and the tip 3C, of the inserting protrusion 3 of the plug 1.

Figure 4A:
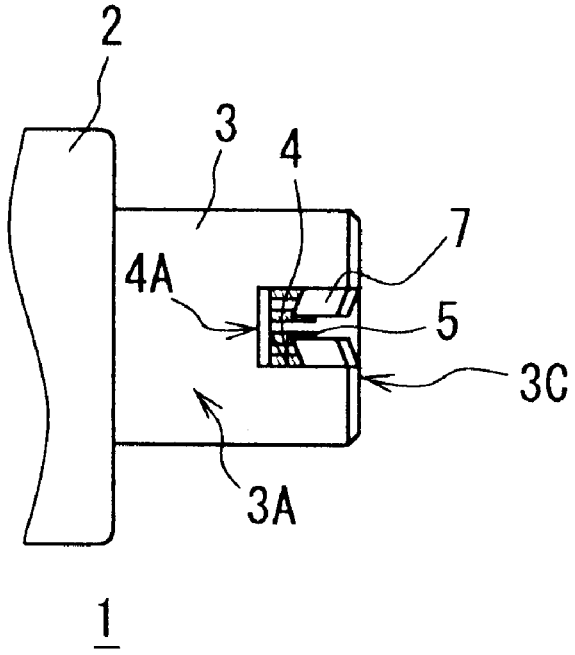
FIGS. 4A and 4B are a schematic diagram and a cross-sectional view illustrating the structure of the plug according to the first embodiment.
Figure 4B:
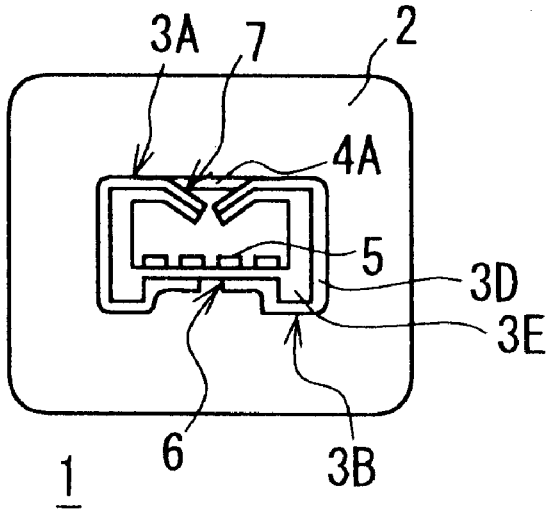
Figure 10:
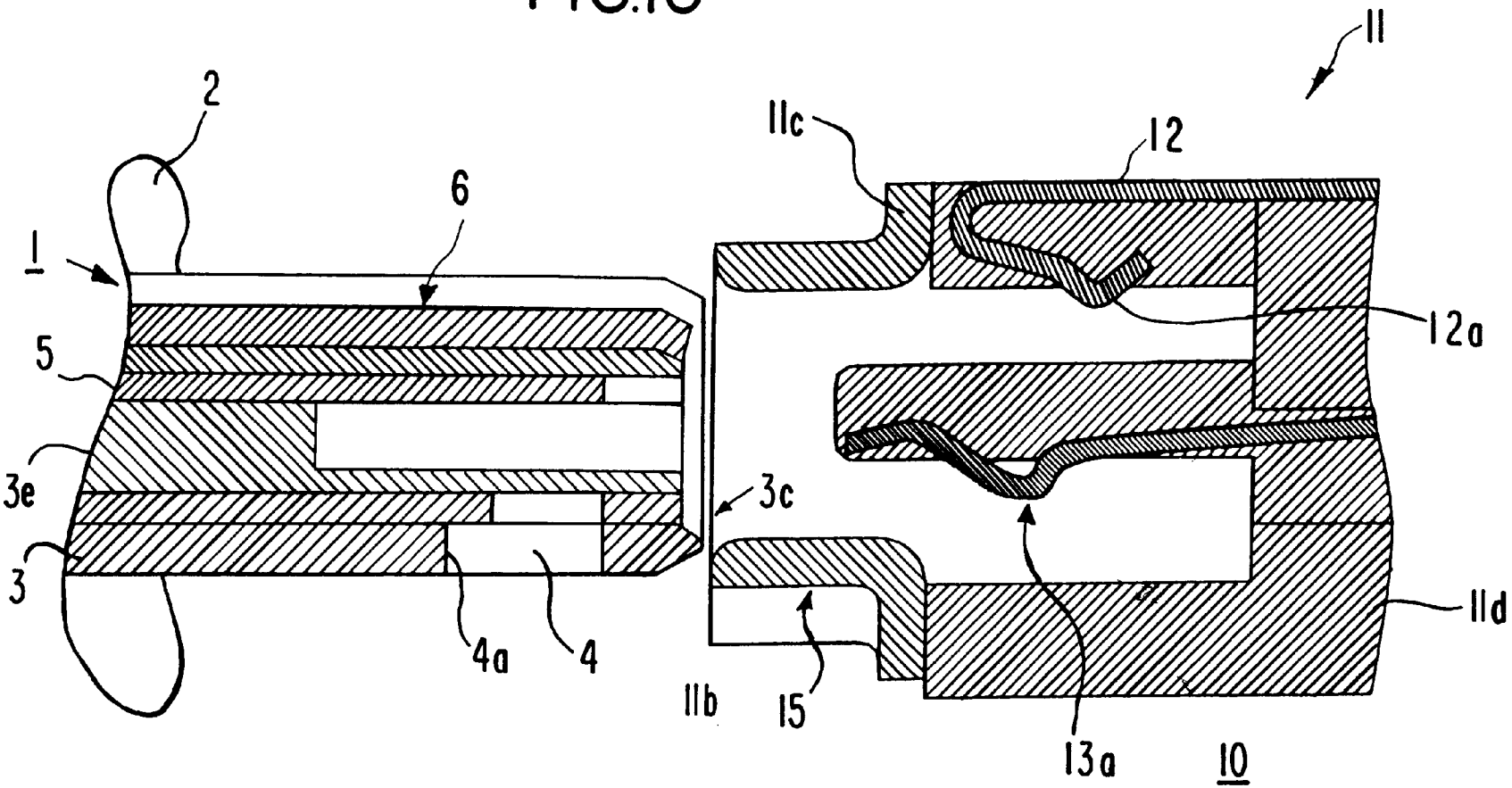
FIG. 10 is a cross-sectional view illustrating a plug and a socket being erroneously fitted together.

In this way, when the plug 1 is erroneously fitted into the socket 10 in reverse, as shown in FIG. 10, the recess 15 of the socket 10 collides with the break absorbing portion 7 of the plug 1, whereby, as illustrated in FIGS. 4A and 4B, the break absorbing portion 7 of the plug 1 is broken, and the recess 15 of the socket 10 runs into one side 4A of the through hole 4 extending in parallel with the tip 3C of the inserting protrusion 3 of the plug 1, thereby preventing the plug 1, as remaining in reverse, from being fitted into the socket 10, and accordingly obviating the socket 10 from being broken.

In the foregoing structure, the connector device 20 has a break absorbing portion 7 formed by cutting a notch into a central portion, between the through hole 4 and the tip 3C, of the inserting protrusion 3 of the plug 1. When the plug 1 is fitted into the socket 10 in reverse, as shown in FIG. 10, the recess 15 of the socket 10 collides with the break absorbing portion 7 of the plug 1 to cause the break absorbing portion 7 to break. In addition, the recess 15 of the socket 10 runs into the one side 4A of the through hole 4 extending in parallel with the tip 3C of the inserting protrusion 3 of the plug 1, thereby preventing the plug 1, as remaining in reverse, from being fitted into the socket 10.

According to this connector device 20, it is therefore possible to obviate the socket 10 from being broken.

Note that, the recess 15 of the socket 10 can be made of tougher material than the break absorbing portion 7 of the plug 1.

Figure 5:
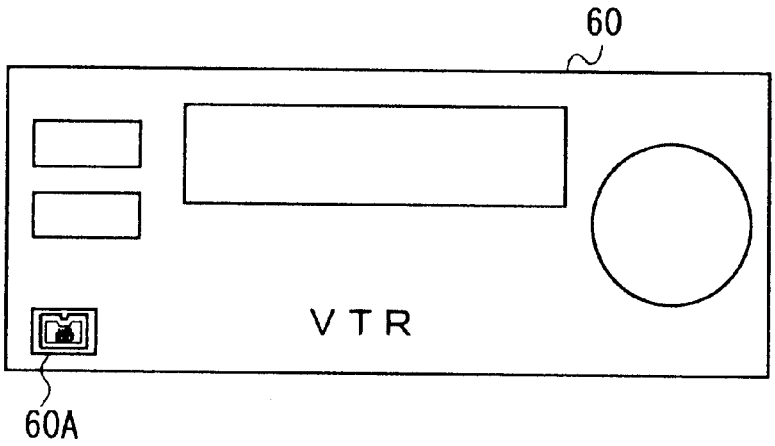
FIG. 5 is a front view of a video tape recorder having the socket shown in FIG. 2.

FIG. 5 is a front view of a video tape recorder (VTR) 60 having the aforementioned socket. The VTR 60 has a socket 60A which is connected to the plug 1 at the left bottom. Note that, the explanation for the socket 60A of the VTR 60 will be omitted because it has the same construction as the aforementioned socket 10.

Figure 6:
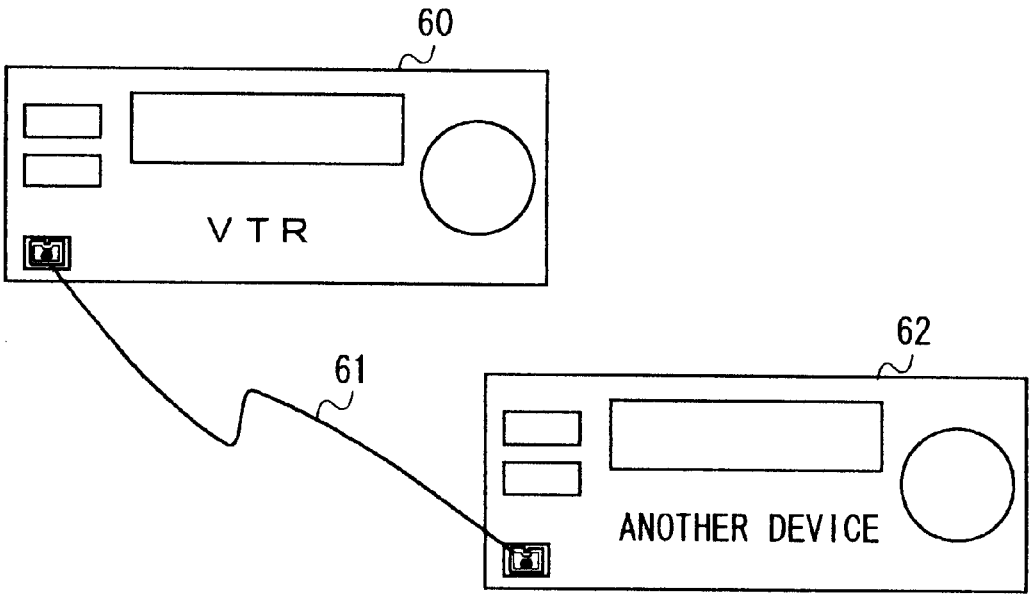
FIG. 6 is a diagram showing the situation where two devices are connected by a cable.

Further, in FIG. 6, the socket 60A of the VTR 60 is connected to another electronic device 62 by a cable 61 having a plug 1 and a socket 10 on the both ends thereof. As a result, information can be communicated between the VTR 60 and another device 62 through the cable. Note that, devices each having the socket 10 can be connected to each other as long as a cable has plugs on the both ends thereof.

According to the foregoing structure, since the break absorbing portion 7 is formed by cutting a notch into a central portion, between the through hole 4 and the tip 3C, of the inserting protrusion 3 of the plug 1 of the connector device 20, when the plug 1 is reversely fitted into the socket 10, the recess 15 of the socket 10 collides with the break absorbing portion 7 of the plug 1 to cause the break absorbing portion 7 to break. In addition, the recess 15 of the socket 10 runs into the one side 4A of the through hole 4 extending in parallel with the tip 3C of the inserting protrusion 3 of the plug 1, thereby preventing the plug 1, as remaining in reverse, from being fitted into the socket 10. It is therefore possible to realize the connector device 20 which can improve the reliability of connection sufficiently for practical use.

(2) Second Embodiment

Figure 7:
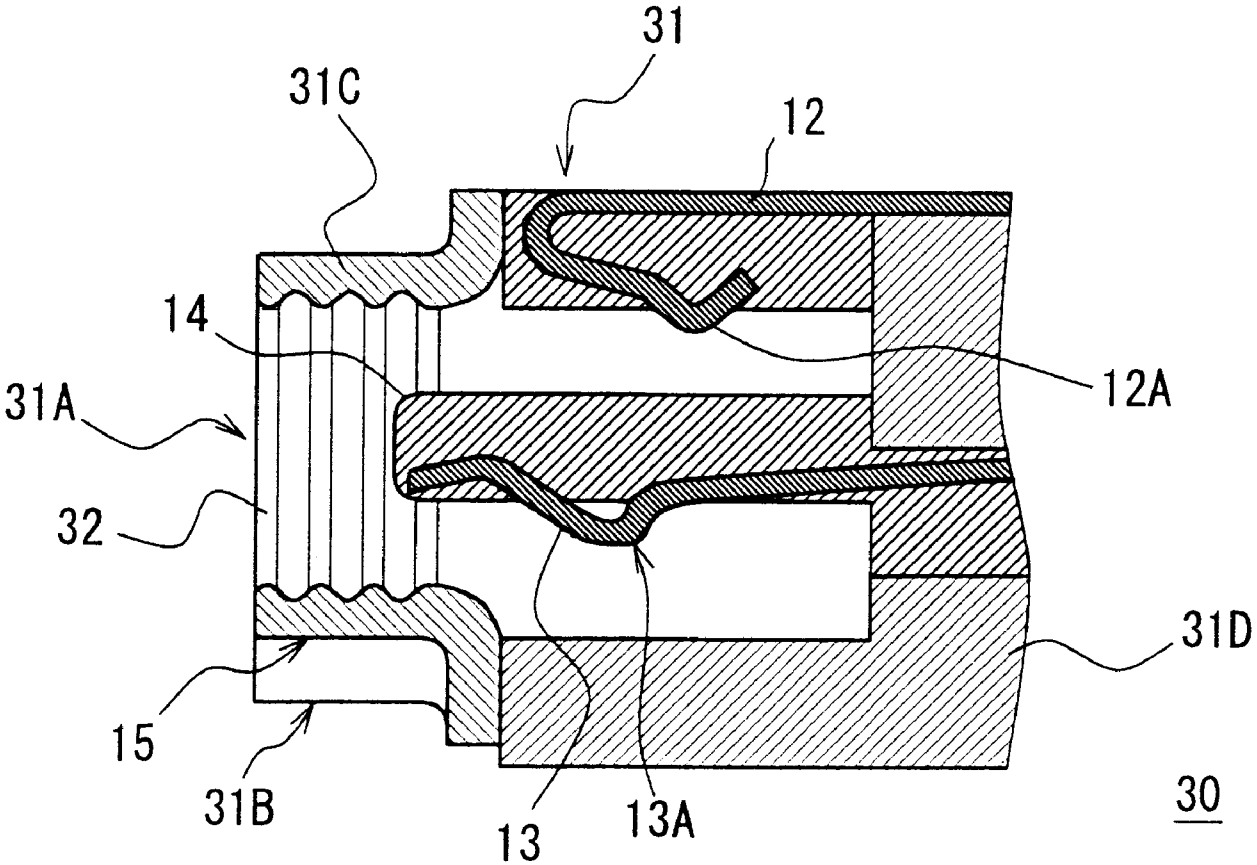
FIG. 7 is a cross-sectional view illustrating the structure of a socket according to a second embodiment.

In FIG. 7, where parts corresponding to those in FIG. 2A are designated the same reference numerals, numeral 30 shows a socket according to a second embodiment, and the socket is constructed similarly to the socket 10 according to the first embodiment, except for an uneven portion 32 formed on each of inner walls of a metal cover 31C inside a receptacle 31A of a main body 31.

Actually, the uneven portions 32 are formed, for example, at a pitch of 0.5 to 1 mm and in a depth of 0.3 to 0.5 mm on each of the inner walls of the metal cover 31C inside the receptacle 31A of the main body 31, as surfaces engaging with the plug 1 of the socket 30, in parallel with the direction in which the plug 1 is fitted.

Figure 8:
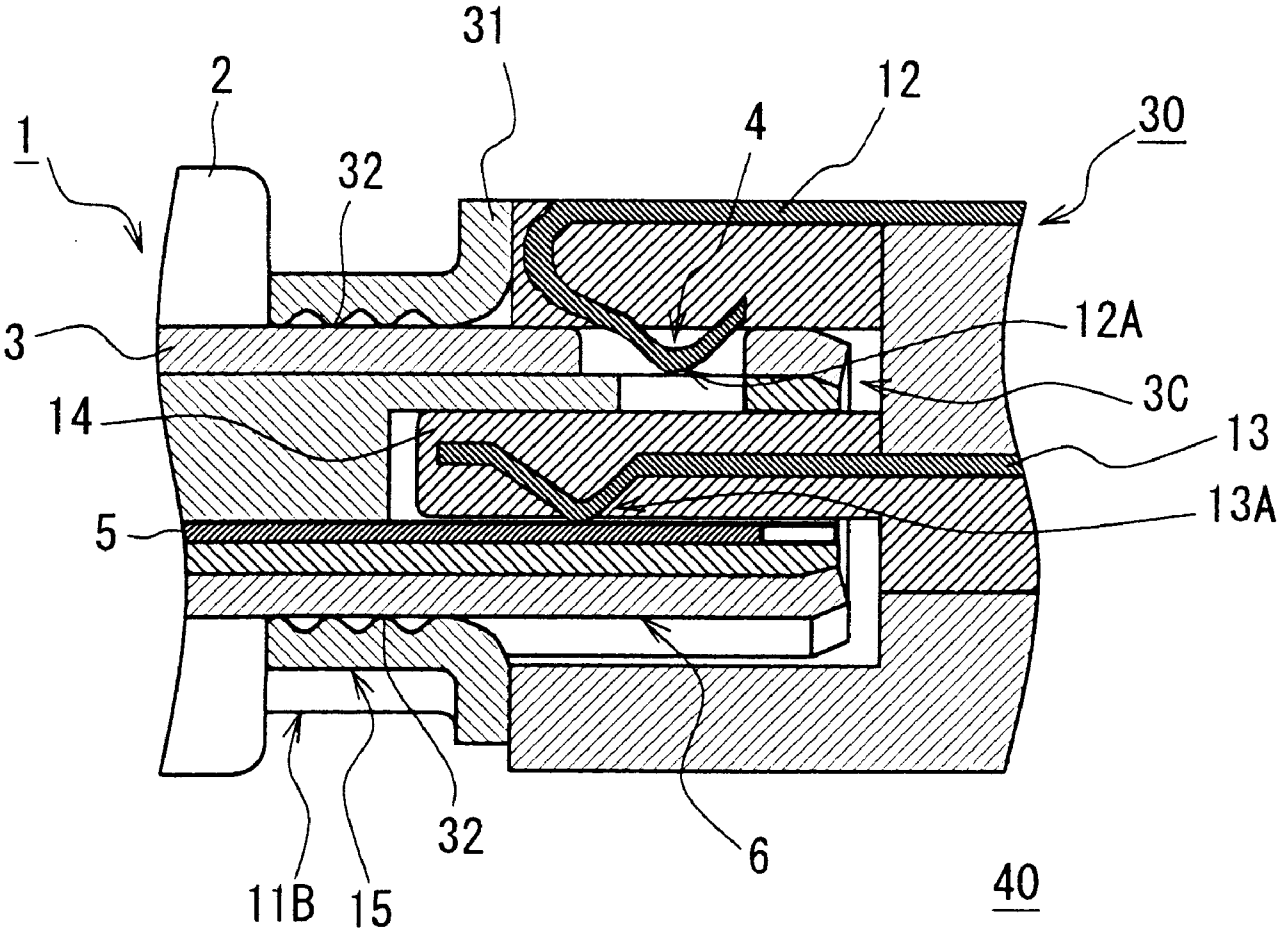
FIG. 8 is a cross-sectional view illustrating the structure of a connector device according to the second embodiment.

With this structure, as illustrated in FIG. 8, where parts corresponding to those in FIG. 3 are designated the same reference numerals, the plug 1 is fitted into the receptacle 31A of the socket 30 with a recess 6 being aligned with a recess 15 of the socket 30, thereby completing a connector device 40.

In this event, if the plug 1 is erroneously inserted obliquely into the receptacle 31A of the socket 30, a tip 3C of the plug 1 is rubbed with the uneven portion 32 formed on any of the inner walls of the receptacle 31 of the socket 30 to make frictional sound. In addition, vibrations resulting from this rubbing are transmitted to the hand, which shows that the plug 1 is not being correctly fitted into the socket 30.

With the foregoing structure, in the connector device 40, the uneven portion 32 is formed on each of inner walls of the metal cover 31C within the receptacle 31A of the main body 31 of the socket 30, such that if the plug 1 is erroneously inserted obliquely into the receptacle 31 of the socket 30, the tip 3C of the plug 1 is rubbed with the uneven portion 32 formed on any of the inner walls of the receptacle 31 of the socket 30 to make frictional sound, and vibrations resulting from this rubbing are transmitted to the hand, which is warning of the situation where the plug 1 is not being correctly fitted into the socket 30.

According to the connector device 40, it is therefore possible to obviate the plug 1 from being obliquely fitted into the socket 30.

According to the foregoing structure, the uneven portion 32 is formed on each of the inner walls of the metal cover 31C inside the receptacle 31A of the a main body 31 of the socket 30 of the connector device 40, such that if the plug 1 is erroneously inserted obliquely into the receptacle 31 of the socket 30, the tip 3C of the plug 1 is rubbed with the uneven portion 32 formed on any of the inner walls of the receptacle 31 of the socket 30 to make frictional sound, and vibrations resulting from this rubbing are transmitted to the hand, which shows that the plug 1 is not being correctly fitted into the socket 30. Therefore, it is possible to prevent the plug 1 of the connector device 40 from being obliquely fitted into the socket 30, and consequently realize the connector device 40 which can improve the reliability of connection sufficiently for practical use.

In the foregoing embodiments, the break absorbing portion 7 of the plug 1 is formed by cutting a notch into a central portion of the top surface 3A, between the through hole 4 and the tip 3C, of the inserting protrusion 3 of the plug 1. The present invention, however, is not limited to this formation. The position at which the notch is formed can be in any region, not limited to a central portion, as long as the position lies between the through hole 4 and the tip 3C of the top surface 3A of the inserting protrusion 3 of the plug 1. Alternatively, a variety of other methods can be applied to the formation of the break absorbing portion 7, provided that the material characteristics are changed by a thermal treatment, a chemical treatment or the like to make only the break absorbing portion 7 more susceptible to breakage or deformation.

Figure 9:
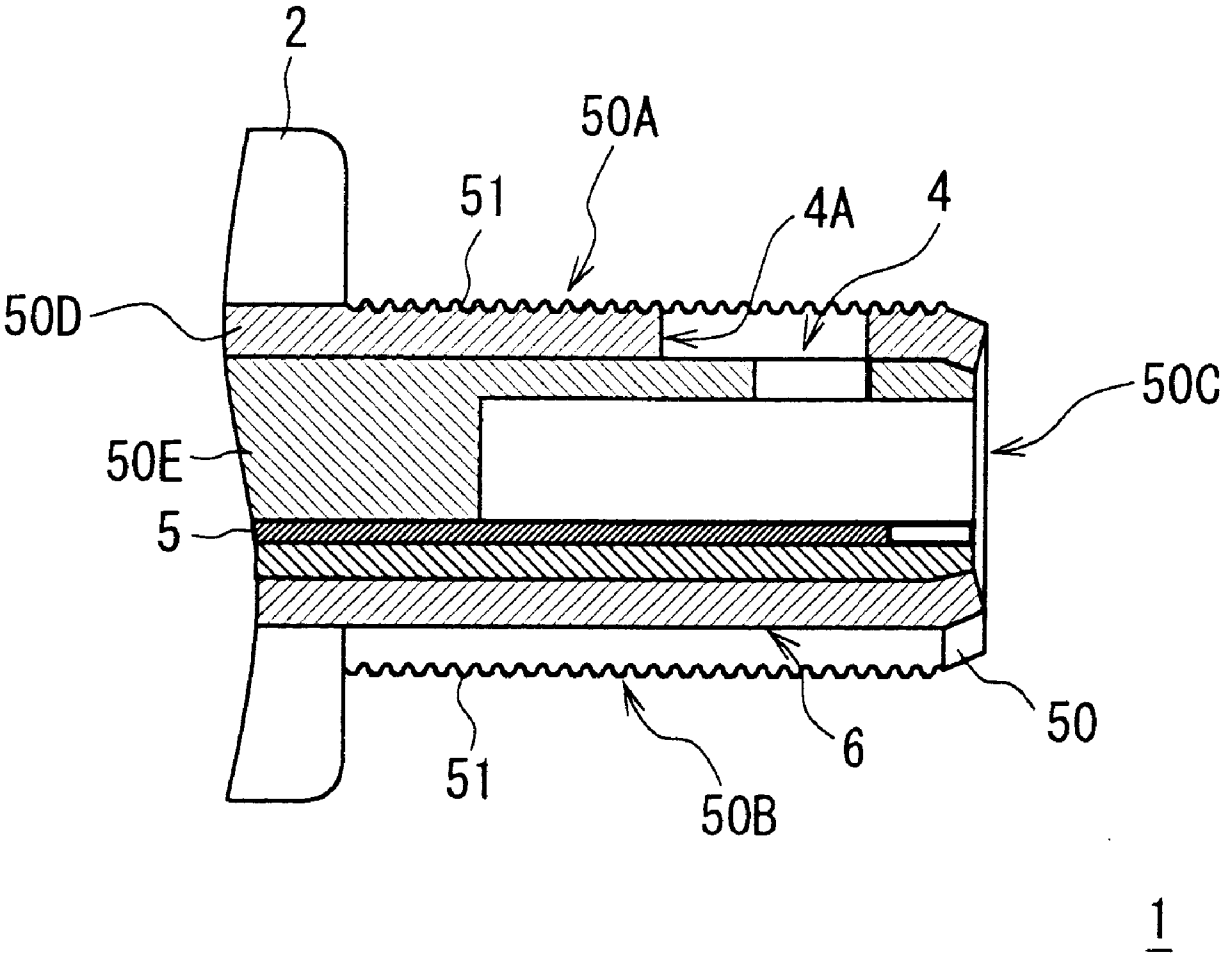
FIG. 9 is a cross-sectional view illustrating the structure of a plug according to another embodiment.

Also, in the foregoing embodiment, the uneven portion 32 is formed on each of inner walls of the metal cover 31C, which are engaging surfaces with the plug 1, inside the receptacle 31A of the a main body 31 of the socket 30. The present invention, however, is not limited to this formation. For example, as illustrated in FIG. 9, uneven portions 51 can be formed on a top surface 50A and a bottom surface 50B of the inserting protrusion 50 of the plug 1, which are surfaces engaging with the socket 30. In essence, a variety of other positions can be widely applied to the formation of the uneven portions 32 and 51 as long as the situation where the plug 1 is fitted obliquely into the socket 30 is evident to the user.

Further, in the foregoing embodiments, the present invention is applied to a video camera. However, the present invention is not limited thereto, but as the connector devices 20 and 40, can be applied widely to a variety of other electronic devices.

As described above, according to the present invention, a connector device has a first connector half having an engaging groove, and a second connector half provided with a protrusion which falls into the engaging groove when the first connector half is fitted thereinto, wherein an erroneous fitting preventing portion is formed in the first connector half so as to be deformed or broken by the protrusion of the second connector half when the first and second connector halves are erroneously fitted. Thus, the socket can be obviated from being broken by deforming or breaking the erroneous fitting preventing portion of the first connector half, consequently making it possible to realize a connector device which can improve the reliability of connection sufficiently for practical use.

Also, according to the present invention, a connector device has a plug and a socket for receiving the plug, wherein uneven portions are formed on engaging surfaces of the plug with the socket or on engaging surfaces of the socket with the plug. Thus, if the plug is inserted into the socket obliquely with respect to the direction in which the plug should be fitted into the socket, the plug or the socket collides with the corresponding uneven portion, so that vibrations corresponding to the uneven portion can be sensed, thereby making it possible to realize a connector device which can obviate the socket from being broken, and improve the reliability of connection sufficiently for practical use.

Further, according to the present invention, a plug, which composes a connector together with a socket having a protrusion, is formed with an engaging groove into which the protrusion of the socket falls, when the plug is fitted into the socket, wherein an erroneous fitting preventing portion is formed so as to be deformed or broken by the protrusion of the socket when the plug is erroneously fitted into the socket. Thus, the socket can be obviated from being broken by deforming or breaking the erroneous fitting preventing portion of the plug, consequently making it possible to realize a plug which can improve the reliability of connection sufficiently for practical use.

Further, according to the present invention, an electronic device has at least a first connector half of a connector including the first connector half having an engaging groove, and a second connector half provided with a protrusion which falls into the engaging groove when the first connector half is fitted thereinto, wherein an erroneous fitting preventing portion is formed in the first connector half so as to be deformed or broken by the protrusion of the second connector half when the first and second connector halves are erroneously fitted. Thus, the socket can be obviated from being broken by deforming or breaking the erroneous fitting preventing portion of the first connector half, consequently making it possible to realize an electronic device which can improve the reliability of connection sufficiently for practical use.

Furthermore, according to the present invention, an electronic device has at least one of a plug and a socket of a connector composed of the plug and the socket into which the plug is fitted, wherein uneven portions are formed on engaging surfaces of the plug with the socket or on engaging surfaces of the socket with the plug. Therefore, if the plug is inserted into the socket obliquely with respect to the direction in which the plug should be fitted into the socket, the plug or the socket collides with the corresponding uneven portion, so that vibrations corresponding to the uneven portion can be sensed. Consequently, it is possible to obviate the socket from being broken, and realize an electronic device which can improve the reliability of connection sufficiently for practical use.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. A connector device composed of a first connector half having an engaging groove and a second connector half provided with a protrusion that falls into said engaging groove when said first connector half is fitted thereinto, said connector device comprising an erroneous fitting preventing portion formed in said first connector half so as to be one of deformed and broken by said protrusion of said second connector half when said first and second connector halves are erroneously fitted together.

2. The connector device according to claim 1, wherein:

said first connector half is a plug; and said second connector half is a socket.

3. A connector device composed of a plug having an engaging groove and a socket provided with a protrusion that falls into said engaging groove when said plug is fitted thereinto, said connector device comprising a breaking portion formed in said plug for breaking by said protrusion of said socket when said plug and said socket are erroneously fitted together.

4. A plug for use with a socket having a protrusion, said plug being provided with an engaging groove into which said protrusion of said socket falls when said plug is fitted thereinto, said plug comprising an erroneous fitting preventing portion provided so as to be one of deformed and broken by said protrusion of said socket when said plug is erroneously fitted into said socket.

5. The plug according to claim 4, wherein said erroneous fitting preventing portion is provided on a side of said plug opposite a side on which said engaging groove is provided.

6. An electronic device having a connector composed of a first connector half and a second connector half provided with a protrusion that falls into an engaging groove formed in said first connector half when said first connector half is fitted said second connector half, said electronic device comprising an erroneous fitting preventing portion provided in said first connector half so as to be one of deformed and broken by said protrusion of said second connector half when said first and second connector halves are erroneously fitted together.

7. The electronic device according to claim 4, wherein:

said first connector half is a plug; and said second connector half is a socket.

8. An electronic device having a connector composed of a first connector half having an engaging groove and a second connector half provided with a protrusion that falls into said engaging groove when said first connector half is fitted into said second connector half, said electronic device comprising a breaking portion formed in said first connector half for breaking by said protrusion of said second connector half when said first connector half and said second connector half are erroneously fitted together.

* * * * *